United States Patent [19]

Ranalli

[11] Patent Number: 4,469,238

[45] Date of Patent: Sep. 4, 1984

[54] PROTECTIVE COVER ARRANGEMENT FOR EQUIPMENT

[76] Inventor: Lawrence A. Ranalli, 127 Borden Rd., Middletown, N.J. 07748

[21] Appl. No.: 575,015

[22] Filed: Jan. 30, 1984

[51] Int. Cl.[3] ..... B65D 51/18

[52] U.S. Cl. ..... 220/254; 220/343; 220/242; 220/377; 174/67; 200/61.62

[58] Field of Search ..... 220/3.7, 254, 259, 242, 220/337, 343, 3.8, 377; 174/67, 48; 339/44 M; 200/61.62, 333, 302, 316, 322; 340/365 S, 365 VL, 365 R; 307/326

[56] References Cited

U.S. PATENT DOCUMENTS 1,946,811 2/1934 Russakov ..... 220/343

4,106,663 8/1978 Nakao ..... 220/343

*Primary Examiner*—George T. Hall

*Attorney, Agent, or Firm*—Kirschstein, Kirschstein, Ottinger & Israel

[57] ABSTRACT

A protective cover arrangement for a computer or a similar machine which has a panel provided with an opening through which access may be had to switches or similar control or actuating devices, this opening being surrounded at least along a part of its periphery by an inwardly extending flange, includes a cover and a clip member on which the cover is mounted for pivoting and which is clampingly mounted on the flange. The clip member includes two arms which clampingly confine the flange between themselves. One of the arms is provided on a clip component, while the other arm is a portion of a hinge component that is mounted on the clip component for adjustment of its position relative thereto, by two screws passing through orifices at least some of which are elongated to provide for the adjustment. Another hinge component is connected to the cover and is pivotably mounted on the first-mentioned hinge component by a pivot pin. An arresting screw is mounted on the first-mentioned hinge component and engages in an aperture of the other hinge component when exercising its arresting function, while being withdrawn from this aperture when it is desired to release the cover for unimpeded pivoting movement about the pivot pin.

18 Claims, 3 Drawing Figures

PROTECTIVE COVER ARRANGEMENT FOR EQUIPMENT

BACKGROUND OF THE INVENTION

The present invention relates to closures in general and, more particularly, to a protective cover arrangement for use in closing an opening provided in a panel of a casing of a computer device and/or component or a similar machine to give access to switches or the like.

There are known various constructions of casings of computers and similar machines, wherein at least one of the panels that constitute the casing is provided with at least one opening through which access may be had to switches and similar control devices for operating the same. Machines of this type of construction include various models of computer devices and/or components manufactured by the IBM Corporation. Such machines are in many instances leased from the manufacturer or from a leasing company and, as a result, cannot be modified or damaged by the user in any manner, lest heavy penalties for such damage or modifications, or their repair, be incurred. However, experience has shown that, when access can be had to the switches and/or other control devices through the opening, it often occurs that the positions or states of the switches or devices are changed either unintentionally by a person brushing or leaning against the casing of the machine and accidentally touching one or more of such switches or devices, or deliberately by a person with innocent or malicious intentions reaching into the opening and operating one or more of the switches or devices.

It will be appreciated that, regardless of whether the actuation of the switches or control devices is deliberate or accidental, such actuation can wreak havoc with the operation of the machine and, more particularly, can cause the alteration and/or the loss of valuable information or introduce a costly delay to the user while executing data recovery procedures. Thus, it would be desirable to be able to close such an opening at least in such a manner as to avoid accidental actuation of the switches or other control devices that are situated behind this opening, but preferably also to prevent deliberate actuation thereof by unauthorized personnel during the absence of the user.

Protective covers or guards of various constructions are known, for instance, from U.S. Pat. Nos. 3,198,373; 3,204,807; 4,197,959; 4,228,317; 4,289,921; 4,348,660; 4,381,500 and 4,394,552. However, all of these known arrangements suffer from so many drawbacks that they cannot be used in the above-described environment. So, for instance, some of these arrangements have to be mounted on the supporting structure by means of screws or similar fasteners which, of course, presupposes damage to the support structure by holes for the fasteners. Another disadvantage of many of these arrangements is that they project from the supporting structures. This, of course, would be disadvantageous in the contemplated environment for use of the cover arrangement since injury could occur to a person accidentally coming into contact with the projecting cover arrangement while, for instance, walking past the machine. Also, if the machine were to be shipped to a different location, for instance, to the manufacturer or to a service installation for repair, then the casing as augmented by the projecting cover arrangement would not readily fit into the shipping package which is dimensioned for the unaugmented casing.

SUMMARY OF THE INVENTION

Accordingly, it is a general object of the present invention to avoid the disadvantages of the prior art.

More particularly, it is an object of the present invention to provide a cover arrangement for closing an opening of a computer device and/or component or a similar machine, which cover arrangement does not possess the disadvantages of the known arrangements of this type.

Still another object of the present invention is so to construct the cover arrangement of the type here under consideration as to be able to mount the same on the machine in a manner that does not result in damage to the machine casing.

It is yet another object of the present invention so to design the cover arrangement of the above type as to be able to selectively arrest it in its closed condition or release it for movement into its open position.

It is another object of the present invention to suspend the cover arrangement so that the cover automatically returns to its closed position under the influence of gravity when released by a user.

Another object of the present invention is to provide a transparent cover which overlies switches or the like that are located within the panel opening so as to permit a user to readily view the state of the switches even in the closed position of the cover.

A concomitant object of the present invention is to develop a cover arrangement of the above type which is simple in construction, inexpensive to manufacture, easy to install and use, and reliable in operation nevertheless.

In pursuance of these objects and others which will become apparent hereafter, one feature of the present invention resides in a protective cover arrangement for use as a closure for an opening of a panel of a casing, especially of a data processing machine such as a computer device and/or component, which opening is bounded at least along a part of its periphery by a flange extending from the panel into the interior of the casing, the protective cover arrangement comprising a substantially plate-shaped cover having an outline substantially corresponding to that of the opening; and means for mounting the cover on the flange of the panel of the casing for pivoting movement between a closing position in which the cover extends across the opening, and an open position in which the cover extends frontwardly from the panel. By being mounted on the flange which extends into the interior of the casing, the protective cover arrangement of the present invention achieves the advantages of being securely mounted on the panel, without marring its external or visible surface, and of not requiring the cutting of any holes or the like into the readily visible region of the panel surrounding the opening at the exterior of the casing.

A particularly advantageous construction according to the present invention results when the mounting means includes a substantially U-shaped clip member of a resilient material, which embraces the flange to clamp the mounting means to the latter, and a hinge member connected to the clip member and to the cover and operative for mounting the latter on the former for the pivoting movement. The clip member, obviously, can be merely slid onto the flange, so that there is no need for damaging even the flange by providing any holes or the like therein.

According to a currently preferred aspect of the present invention, the hinge member includes a first hinge component secured to the cover and bounding a first passage, a second hinge component bounding a second passage that is aligned with the first passage in an assembled condition of the hinge member, a pivot pin extending through the first and second passages in the assembled condition, and means for securing the second hinge component to the clip member. The securing means advantageously includes a mounting portion of the second hinge component, a support portion of the clip member that is juxtaposed with the mounting portion of the second hinge component when assembled therewith, means for bounding respective first and second orifices in the mounting and support portions respectively, the orifices being aligned with one another when the second hinge component is assembled with the clip member, and at least one threaded fastener extending through the aligned orifices and engaging the mounting and support portions to mount the second hinge component on the clip member.

It is particularly advantageous in this context when at least one of the orifices is elongated in the direction substantially along the flange as considered in the mounted condition of the protective cover arrangement to permit adjustment of the position of the hinge member along the clip member and thus the position of the cover relative to the opening of the panel.

The elongated orifice is so dimensioned as to permit positioning of the cover in the closing position thereof substantially within the opening of the panel and flush with the external surface of the panel for all those sizes and angles of the flanges as considered in the inward direction of the casing that are encountered in various types of the machine supplied by the same manufacturer.

Advantageously, one of the first and second components is so connected to the pivot pin as to be immovable relative thereto and form a unit therewith, and there is further provided means for releasably arresting the cover in the closing position thereof, including a threaded element mounted on the other of the hinge components for movement between a releasing position in which it disengages,and an arresting position in which it arrestingly engages, the aforementioned unit. In this respect, it is particularly advantageous when the other hinge component includes an internally threaded aperture meshingly receiving the threaded element, and when the one hinge component has another aperture that is aligned with the internally threaded aperture in the closing position and receives a portion of the threaded element in the arresting position of the latter.

According to a particularly advantageous facet of the present invention which is particularly useful when the panel that is provided with the opening is movable relative to the remainder of the casing, the arresting means is so positioned that the arresting element is accessible only from the inner side of the panel. This is particularly advantageous when this panel is mounted on the remainder of the casing for pivoting relative thereto about a hinge, and when a lock is provided for locking the panel in its closed position. This, of course, means that access can be had to the arresting element only after the panel lock has been unlocked and the panel has been moved toward its open position.

The clip member advantageously has two arms each of which is arranged at a different side of the flange when the clip member clamps the latter, at least one of the arms having an undulating configuration to present a series of alternating ridges and depressions to the flange. In this respect, it is currently preferred to so arrange the ridges as to extend substantially transversely of the direction in which the clip member is assembled with and disassembled from the flange.

Advantageously, the present invention is used with a panel whose opening is polygonal, especially rectangular, and is surrounded by the flange from all sides, in which event the mounting means mounts the cover on that region of the flange which is situated upwardly of the opening.

It is especially advantageous to make the cover of a transparent material, since then the positions of any switches or other control devices arranged behind the opening can be observed even when the cover is in its closing position. The cover is advantageously provided with a fingernail-engaging recess at a zone thereof that is remote from, or adjacent to the mounting means for ease of moving the cover; that is, this recess provides a convenient grip or fingerhold for the user by which the cover may be pivoted to its open position.

The novel features which are considered as characteristic of the invention are set forth in particular in the appended claims. The protective cover arrangement for a computer device and/or component itself, however, both as to its construction and its mode of operation, together with additional features and advantages thereof, will be best understood upon perusal of the following detailed description of certain specific embodiments with reference to the accompanying drawings.

DETAILED DESCRIPTION OF THE PREFERRED EMBODIMENT

Figure 1:
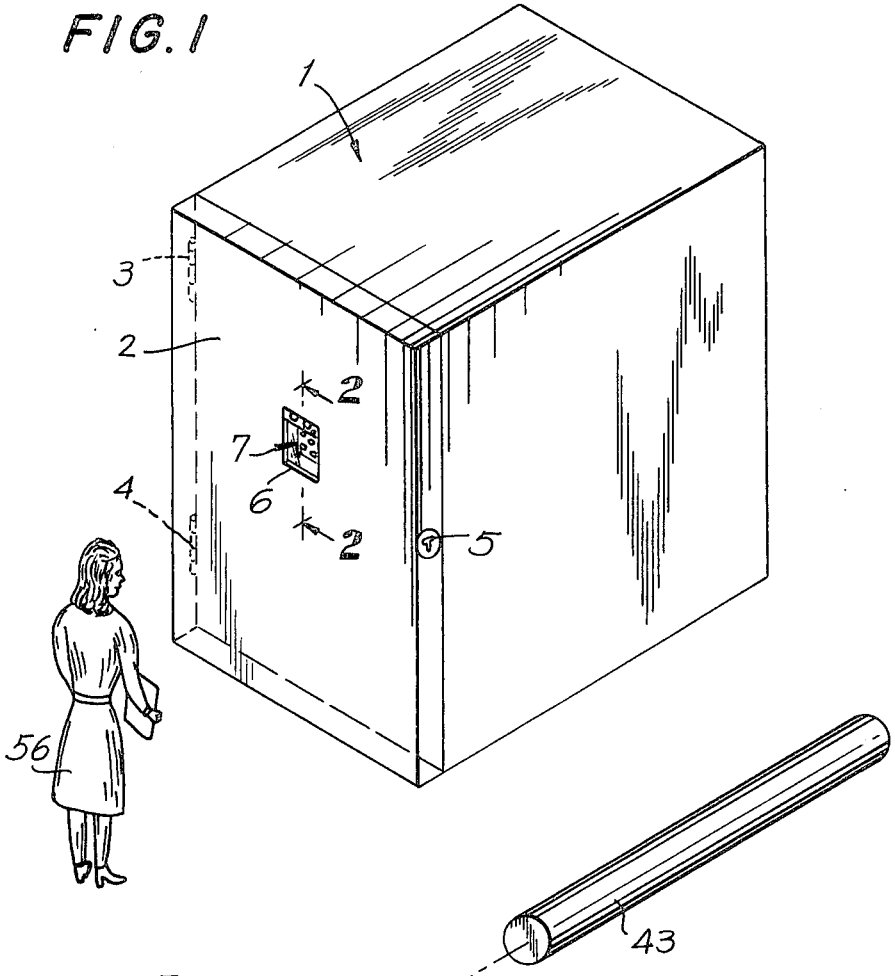
FIG. 1 is a perspective view of a casing of a computer device and/or component which includes a front panel provided with an opening that is closed by a protective cover arrangement in accordance with the present invention.

Referring now to the drawings in detail, and first to FIG. 1 thereof, it may be seen that the reference numeral 1 has been used therein to identify a casing of a machine, particularly of a computer device and/or component or a similar data processing machine. The casing 1 includes a front panel 2 which is shown to be mounted on the remainder of the casing 1 for movement relative thereto by means of hinges 3 and 4. The front panel 2 is provided with a closing and/or locking arrangement 5, and with an opening 6 that can be closed, and is shown to be closed, by a protective cover arrangement 7 of the present invention.

Figure 3:
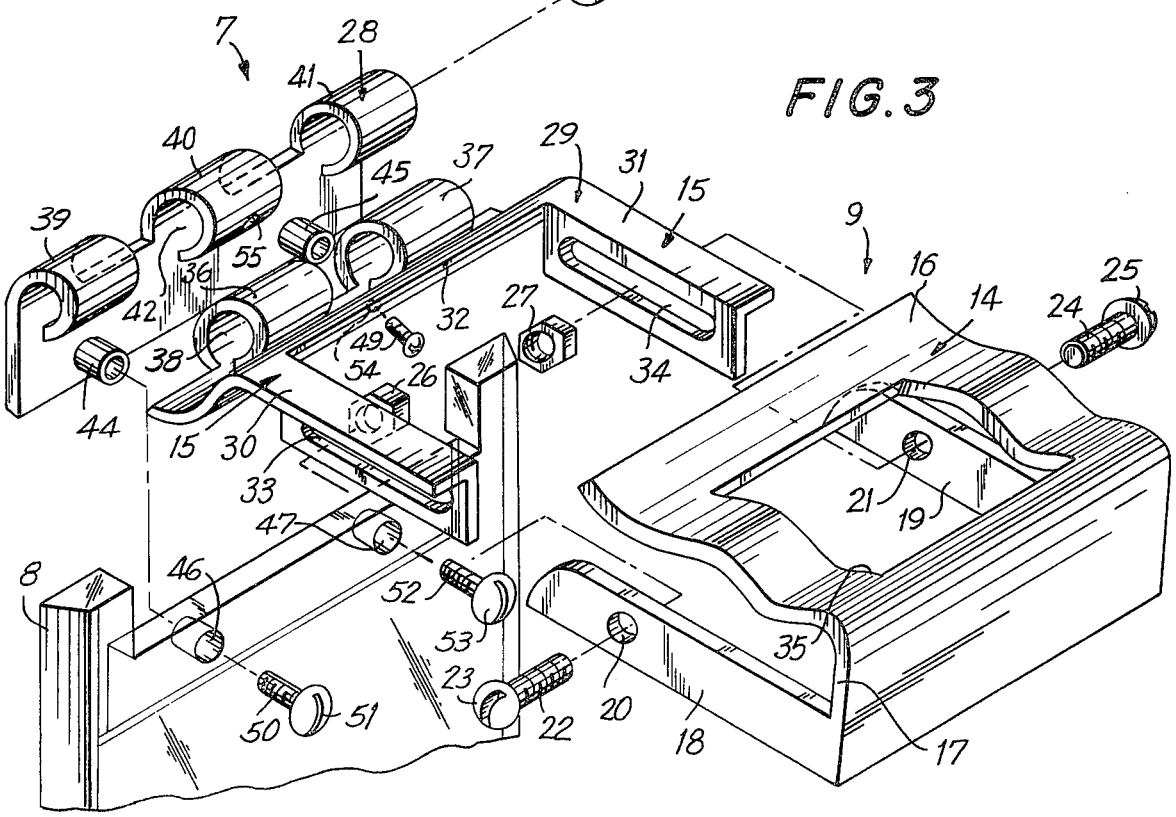
FIG. 3 is a partly fragmentary, exploded view of the protective cover arrangement of the present invention.
Figure 2:
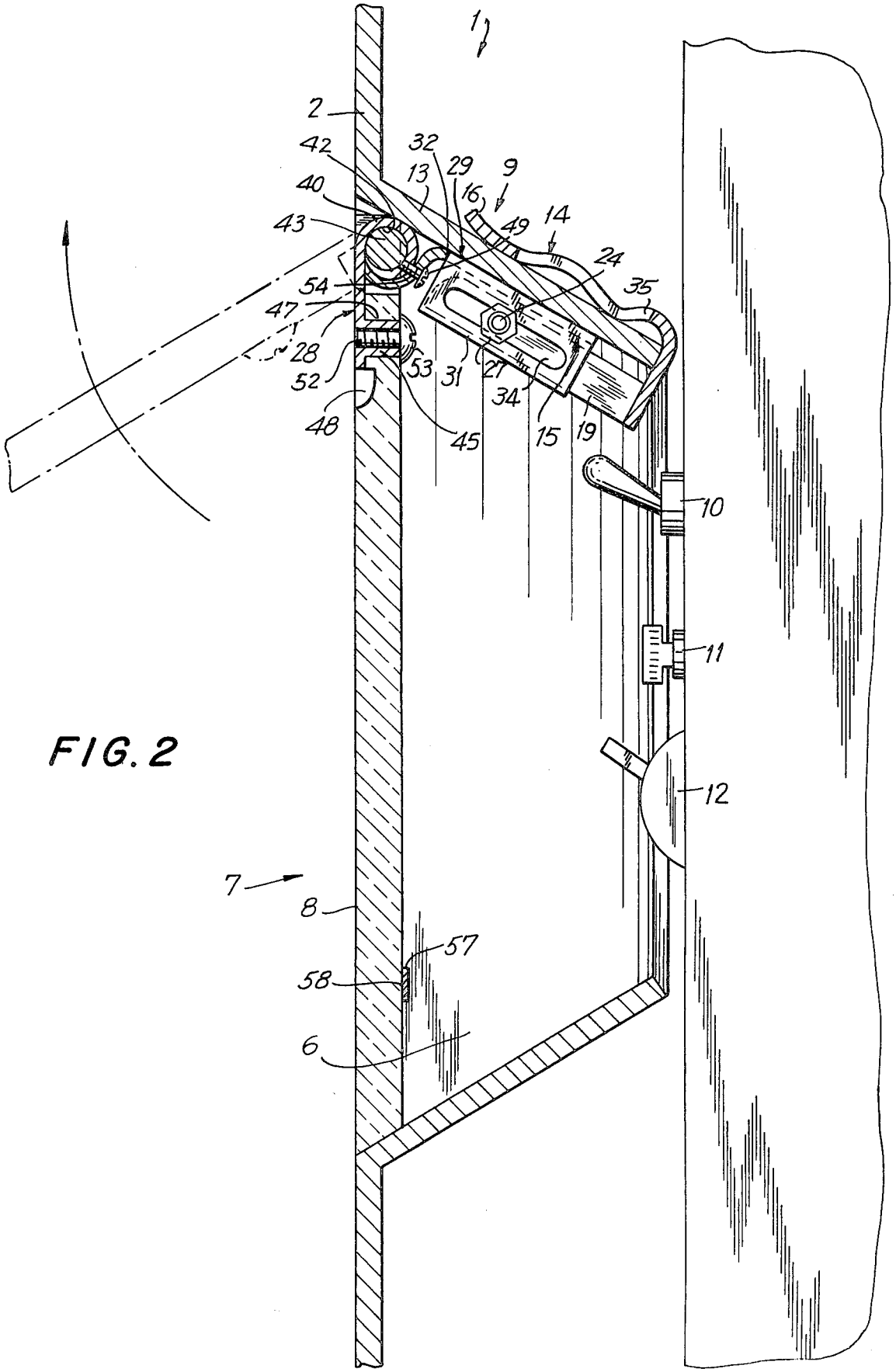
FIG. 2 is a partially sectioned view taken along line 2—2 of FIG. 1, on an enlarged scale.

The details of the cover arrangement 7 are shown in FIGS. 2 and 3. As shown in FIG. 2, the protective cover arrangement 7 includes as one of its main components a cover 8 which is made of a transparent synthetic plastic material. A mounting arrangement 9 mounts the cover 8 on the front panel 2 for pivoting between a closed position shown in full lines in FIG. 2, and an open position shown in phantom lines. In its open position, the cover 8 permits access to switches, pushbuttons and/or other control devices 10, 11 and 12 which are arranged in the interior of the casing 1 in alignment with the opening 6.

The front panel 2 of the casing 1 has a flange 13 which peripherally bounds the opening 6 and terminates short of the area carrying the control devices 10, 11 and 12 at an outward spacing from the latter. The mounting arrangement 9 is constructed in a manner resembling a clip and is shown to confine or clamp the upper region of the flange 13 between its arms 14 and 15.

As shown particularly in FIG. 3, the mounting arrangement or clip 9 includes a clip member 16 including, in addition to the above-mentioned arm 14, a connecting portion 17 and two lateral portions 18 and 19. Each of the lateral portions 18 and 19 is provided with a respective orifice 20 and 21. Stems 22 and 24 of respective screws 23 and 25 pass through the respective orifices 20 and 21, and respective nuts 26 and 27 are threaded and tightened thereon in the assembled condition of the arrangement 9.

The mounting arrangement 9 further includes a first hinge component 28 and a second hinge component 29. The second hinge component 29 includes two lateral portions 30 and 31, and a connecting portion 32 interconnecting the lateral portions 30 and 31. The lateral portions 30 and 31 are provided with respective elongated, slot-shaped orifices 33 and 34 through which the stems 22 and 24 respectively pass in the assembled condition of the arrangement 9. The lateral portions 30 and 31 together constitute the aforementioned arm 15.

The arm 14 of the clip member 16 is provided with a central cutout which primarily serves to reduce the mass of the clip member 16 and is identified by the reference numeral 35. The arm 14 has an undulating configuration to increase local pressure between the arm 14 and the flange 13 and thus to assure retention of the mounting arrangement 9 on the flange 13. The second hinge member 29, due to the use of the portions 30, 31 and 32, is also of a relatively light-weight, but still sturdy, construction.

The connecting portion 32 of the second hinge component 29 carries two tubular hinging zones 36 and 37 that define a passage 38 therethrough, while the first hinge component 28, which is otherwise substantially plate-shaped, is similarly provided with three hinging zones 39, 40 and 41 which together bound a passage 42. The hinging zones 39, 40 and 41 are so spaced from one another as to receive the hinging zones 36 and 37 between themselves, so that the passages 38 and 42 are aligned with one another. A pivot pin 43 is then coaxially received in the aligned passages 38 and 42, and mounts the first hinge component 28 on the second hinge component 29 for the above-mentioned pivoting movement between the open and closed positions.

The first hinge component 28 carries two threaded tubular pins 44 and 45 which pass through associated holes 46 and 47 of the cover 8. As shown in FIG. 3, stems 50, 52 of respective screws 51, 53 pass through holes 46, 47 and threadedly engage the interior threaded passages of pins 44, 45 for connecting the cover 8 to the first hinge component 28. FIG. 2 shows that the cover 8 is provided with a fingernail-engaging recess 48, by means of which the cover 8 can be displaced out of the shown closing position and toward the open position.

As described so far, the cover 8 will provide protection for the devices 10, 11 and 12 against accidental actuation when in its closed position, yet will be easily displaceable toward its open position. Now, to provide a measure of protection against deliberate tampering with the switches or other devices 10, 11 and 12, it is provided, according to the present invention, for arresting of the cover 8 in the closed position. This arresting action is achieved by the use of an arresting element or screw 49 which, as a comparison of FIGS. 2 and 3 will reveal, passes through an internally threaded aperture 54 of the connecting portion 32 and can be threaded into an aperture 55 of the hinging zone 40 when it is desired to achieve the arresting action, and out of the aperture 55 when it is desired to release the first hinge component 28 and thus the cover 8 for the aforementioned pivoting movement about the pivot pin 43. The arresting screw 49 is accessible only from the inside of the panel 2, so that it can be actuated, that is, displaced into and out of its arresting position, only when the panel 2 is in its open position relative to the remainder of the casing 1. Hence, it is possible to use the arrangement 7 to deny access to the switches or devices 10,11 and 12 to anybody but the authorized personnel, by arresting the cover 8 in its closed position using the arresting screw 49, in that opening of the panel 2 is needed for either directly gaining access to the actuating devices 10, 11 and 12, or for releasing the arresting screw 49.

While it was mentioned before that the pins 44 and 45 are internally threaded, it is equally possible to make them hollow and to pass separate rivets therethrough.

As shown in FIG. 1, the opening 6 is located at about eye level relative to a user 56. However, the opening may in some models of the machine be located at any elevation and on any panel.

Another advantageous feature of this invention is embodied in providing decalcomania 57 on the cover and graphics 58 on one or both sides of the decalcomania 57 so that the user can tell at a glance at the front of the cover that the orientation of the switches should not be changed, and at a glance at the rear of the cover what the correct orientation of the switches and control devices should be.

As noted previously, the flange 13 for different types of the machine may have different sizes and angles relative to the front panel. The adjustability of the clip and hinge members permits an installer to detachably mount the protective cover arrangement on the flange such that the cover is substantially flush with the front panel regardless of the various normally encountered angles at which the flange may be oriented, and regardless of the distance at which the switches and control devices are normally located interiorly of the front panel, and regardless of the extent to which the normally encountered flange extends interiorly of the front panel.

To insure a flush mounting, the peripheral top, bottom and side edges of the cover 8 are bevelled to matingly conform to the flange 13.

The retention of the clip 9 on the flange 13 is facilitated by the resilient nature of the clip, which may advantageously be constituted of resilient metal or plastic material. In cases where the clip 9 is not constituted of a resilient material, it may be desirable to improve the clip retention by providing a threaded fastener such as a screw which threadedly engages a tapped hole in the clip and which extends perpendicularly to the plane of the clip to bitingly engage the flange and thereby secure the clip thereon.

It will be understood that each of the elements described above, or two or more together, may also find a useful application in other types of arrangements differing from the type described above.

While the invention has been illustrated and decribed as embodied in a protective cover arrangement for a computer or a similar data processing machine of relatively large dimensions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A protective cover arrangement for use as a closure for an opening in a panel of a casing, especially of a data processing machine such as a computer, which opening is bounded at least along a part of its periphery by a flange extending from the panel into the interior of the casing, comprising a substantially plate-shaped cover having an outline substantially corresponding to that of the opening; and means for mounting said cover on the flange of the panel of the casing for pivoting movement between a closing position in which said cover extends across said opening, and an open position in which said cover extends frontwardly from the panel.

2. The protective cover arrangement as defined in claim 1, wherein said mounting means includes a substantially U-shaped clip member of a resilient material, which embraces the flange to clamp said mounting means to the latter, and a hinge member connected to said clip member and to said cover and operative for mounting the latter on the former for said pivoting movement.

3. The protective cover arrangement as defined in claim 2, wherein said hinge member includes a first hinge component secured to said cover and bounding a first passage, a second hinge component bounding a second passage that is aligned with said first passage in an assembled condition of said hinge member, a pivot pin extending through said first and second passages in said assembled condition, and means for securing said second hinge component to said clip member.

4. The protective cover arrangement as defined in claim 3, wherein said securing means includes a mounting portion of said second hinge component, a support portion of said clip member that is juxtaposed with said mounting portion of said second hinge component when assembled therewith, means for bounding respective first and second orifices in said mounting and support portions respectively, said orifices being aligned with one another when said second hinge component is assembled with said clip member, and at least one threaded fastener extending through said aligned orifices and engaging said mounting and support portions to mount said second hinge component on said clip member.

5. The protective cover arrangement as defined in claim 4, wherein at least one of said orifices is elongated in the direction substantially along the flange as considered in the mounted condition of the protective cover arrangement to permit adjustment of the position of said hinge member along said clip member and thus the position of said cover relative to said opening.

6. The protective cover arrangement as defined in claim 5, wherein said elongated orifice is so dimensioned as to permit positioning of said cover in said closing position thereof substantially within said opening and flush with the external surface of the panel for all those dimensions of the flange as considered in the inward direction of the casing that are encountered in various types of the machine supplied by the same manufacturer.

7. The protective cover arrangement as defined in claim 3, wherein one of said first and second hinge components is so connected to said pivot pin as to be immovable relative thereto and form a unit therewith; and further comprising means for releasably arresting said cover in said closing position thereof, including a threaded element mounted on the other of said hinge components for movement between a releasing position in which it disengages, and an arresting position in which it arrestingly engages, said unit.

8. The protective cover arrangement as defined in claim 7, wherein said other hinge component has an internally threaded aperture meshingly receiving said threaded element and said one hinge component has another aperture that is aligned with said internally threaded aperture in said closing position and receives a portion of said threaded element in said arresting position of the latter.

9. The protective cover arrangement as defined in claim 8 for use on a machine in which the panel provided with the opening is movable relative to the remainder of the casing, wherein said arresting means is so positioned that said arresting element is accessible only from the inner side of the panel.

10. The protective cover arrangement as defined in claim 2, wherein said clip member has two arms each of which is arranged at a different side of the flange when said clip member clamps the latter, at least one of said arms having an undulating configuration to present a series of alternating ridges and depressions to the flange.

11. The protective cover arrangement as defined in claim 10, wherein said ridges extend substantially transversely of the direction in which said clip member is assembled with and disassembled from the flange.

12. The protective cover arrangement as defined in claim 1 for use with a panel whose opening is polygonal and surrounded by the flange from all sides, wherein said mounting means mounts said cover on that region of said flange which is situated upwardly of the opening.

13. The protective cover arrangement as defined in claim 1, wherein said cover is of a transparent material.

14. The protective cover arrangement as defined in claim 1, wherein said cover has a fingernail-engaging recess at a zone thereof that is adjacent to said mounting means.

15. The protective cover arrangement as defined in claim 1 for use with a panel whose opening is polygonal and surrounded by the flange from all sides, wherein said mounting means detachably mounts said cover on that region of said flange which is situated upwardly of the opening in a suspended, non-marring manner.

16. The protective cover arrangement as defined in claim 15, wherein said cover has bevelled peripheral edges which conformingly mate with the polygonal opening.

17. A protective cover arrangement for use as a closure for protecting controls arranged behind an opening in a panel of a machine casing, said opening being bounded at least along a part of its periphery by a flange extending from the panel into the interior of the casing, comprising:

(a) a substantially plate-shaped transparent cover having an outline substantially corresponding to that of the opening; and (b) means for readily detachably mounting said cover on the flange of the panel of the casing such that said cover is seated in said opening and overlies the controls visible through the cover, said cover having an outer surface which lies in substantially the same plane as the outer surface of the panel of the casing.

18. A protective cover arrangement for use as a closure for protecting controls arranged behind a substantially polygonal opening formed in a panel of a casing of a machine such as a computer device and/or component, said opening being bounded along its periphery by a substantially polygonal flange extending from the panel into the interior of the casing, said flange having an upper flange part extending downwardly at an angle relative to the panel toward the controls and terminating short thereof, said arrangement comprising:

(a) a substantially plate-shaped transparent cover having a substantially polygonal shape which corresponds to that of the opening, said cover having top, bottom and side bevelled edges which conformingly mate with the flange bounding the opening;

(b) means for readily detachably mounting said cover on the upper flange part of the flange for pivoting movement between a closing position in which said cover extends across the opening and overlies the controls which are visible through the cover, and an open position in which said cover extends frontwardly from the panel and permits access to the controls, (i) said mounting means including a substantially U-shaped clip member of a resilient material which embraces the upper flange part to clamp the mounting means to the latter, and a hinge member connected to said clip member and to said cover and operative for mounting the latter on the former for said pivoting movement, (ii) said mounting means being operative for positioning said cover in its closing position such that an outer surface thereof lies in substantially the same plane as an outer surface of the panel, (iii) said hinge member permitting said cover to automatically return under the influence of gravity from its open position to its closing position.

* * * * *